US005232353A

United States Patent [19]

Grant

[11] Patent Number: 5,232,353

[45] Date of Patent: Aug. 3, 1993

[54] PRESSURIZED DIAPHRAGM PUMP AND DIRECTIONAL FLOW CONTROLLER THEREFOR

[76] Inventor: Benton H. Grant, 126 Chestnut Hill Rd., Stamford, Conn. 06903

[21] Appl. No.: 817,145

[22] Filed: Jan. 6, 1992

[51] Int. Cl.[5] ..... F04B 17/00

[52] U.S. Cl. ..... 417/413 R

[58] Field of Search ..... 417/413 R, 413 R, 572, 417/413 B; 137/625.46, 624.13

[56] References Cited

U.S. PATENT DOCUMENTS

| | | | |
|---|---|---|---|
| 2,788,170 | 11/1953 | Kato et al. . | |
| 3,371,852 | 6/1966 | Holt . | |
| 3,443,519 | 5/1969 | White . | |
| 3,750,840 | 8/1973 | Holme | 417/312 |
| 3,838,944 | 10/1974 | Kolfertz | 417/312 |
| 3,989,415 | 11/1976 | Van-Hee et al. | 417/312 |
| 4,197,837 | 4/1980 | Tringali et al. | 137/565.1 |
| 4,352,642 | 10/1982 | Murayama et al. | 417/312 |
| 4,610,608 | 9/1986 | Grant | 417/413 |
| 4,829,616 | 5/1989 | Walker | 5/453 |
| 4,834,625 | 5/1989 | Grant | 417/413 |
| 5,009,579 | 4/1991 | Grant | 417/413 |
| 5,052,904 | 10/1991 | Itakura et al. | 417/413 |
| 5,118,418 | 6/1992 | Roussel | 137/625.46 |

FOREIGN PATENT DOCUMENTS

| | | | |
|---|---|---|---|
| 0256576 | 12/1985 | Japan | 417/413 |

*Primary Examiner*—Richard A. Bertsch
*Assistant Examiner*—Alfred Basichas
*Attorney, Agent, or Firm*—St. Onge Steward Johnston & Reens

[57] ABSTRACT

A diaphragm pump is provided comprising a pump chamber, a diaphragm, an enclosure, a diaphragm reciprocator, and an enclosure pressure regulator. A valve which may be used with the diaphragm pump is also provided. The valve comprises a chamber, a chamber pressure regulator, and a timer motor for rotating a rotor to control fluid communication between the chamber and a fluid outlet.

20 Claims, 5 Drawing Sheets

FIG. 4
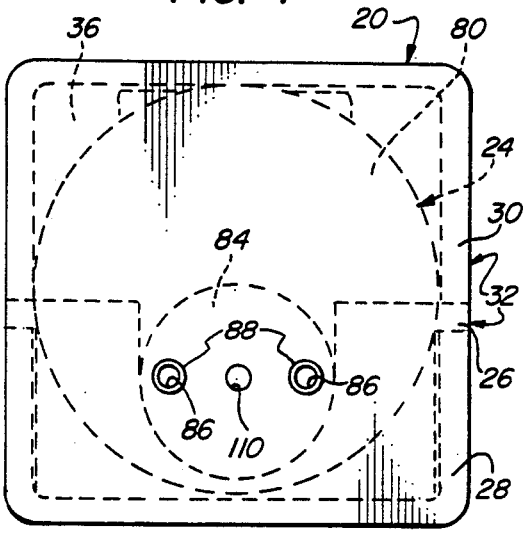
FIG. 5
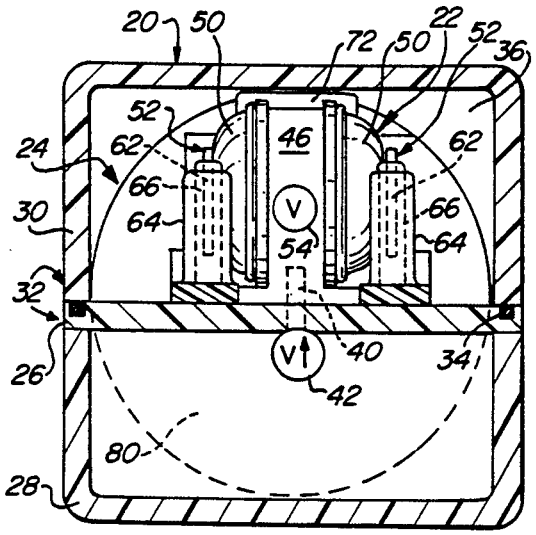
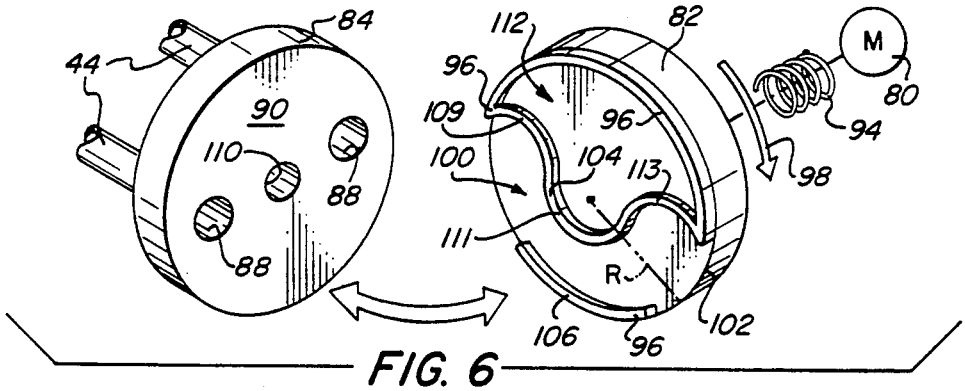
FIG. 6
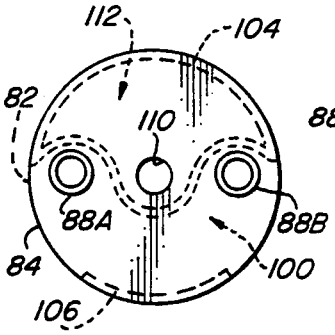
FIG. 7A
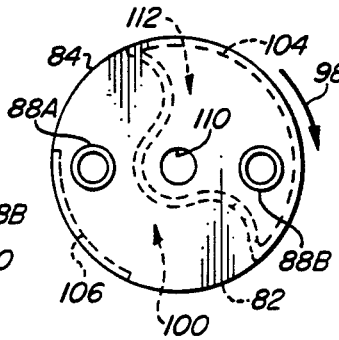
FIG. 7B
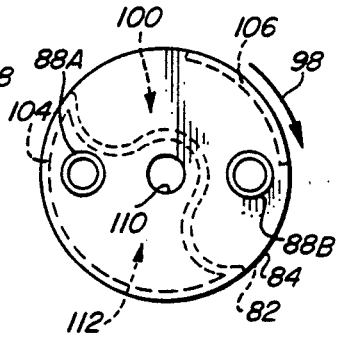
FIG. 7C

PRESSURIZED DIAPHRAGM PUMP AND DIRECTIONAL FLOW CONTROLLER THEREFOR

FIELD OF THE INVENTION

This invention relates to diaphragm pumps having pressurized enclosures and to directional flow controllers which may be used with pumps having pressurized enclosures.

BACKGROUND OF THE INVENTION

Conventional diaphragm pumps typically operate substantially at the surrounding or ambient pressure of the fluid being pumped, e.g. atmospheric pressure for air pumps. From the moment a conventional diaphragm pump begins operating, and especially where the pump outlet is connected to a load such as a bladder to be expanded or inflated, a back pressure develops within the pump chamber and outlet line. This back pressure tends to outwardly distend or "balloon" the pump's diaphragm. One disadvantage of ballooning diaphragms is excess wear necessitating more frequency replacement of diaphragms. Another disadvantage is the oversized enclosures necessary to contain ballooned diaphragm pump chambers.

Some diaphragms pumps incorporate directional flow controllers or valves, such as that disclosed in my earlier U.S. Pat. No. 5,009,579. These flow controllers function to meter pump output among one or more outputs for example, the controllers may be used to alternately inflate bladders A and B of a bed pad or the like. Known controllers include a mating plate and rotor. Pump output is provided to the stationary plate by tubing and associated fittings and, as the motor rotates, is directed along one or more output lines by an intricate etched pattern on the sealed mating surfaces of the plate and rotor. A vent may also be provided.

One disadvantage of these directional flow controllers is that the back pressure created in the output lines, as well as the output pressure of the diaphragm pump, tend to push the plate and rotor apart breaking their seal and thereby disrupting directional control of the pressurized fluid pump outlet. A related disadvantage is that since the rotor must be more strenuously biased against the plate to preserve the seal, the timer used to rotate the rotor must be capable of providing higher torque, and thus be of greater size and use more energy than would otherwise be necessary. Further disadvantage include the substantial cost of etching the plate and rotor, and the increased assembly and parts costs associated with such designs.

SUMMARY OF THE INVENTION

Accordingly, it is an object of the invention to provide a diaphragm pump with reduced ballooning of the diaphragm. It is another object of the invention to provide a pressurized enclosure for a diaphragm pump. It is a further object of the invention to provide a more economical directional flow controller. It is yet another object of the invention to provide a pressurized enclosure for a directional flow controller. It is still another object of the invention to provide an improved fluid pump assembly including a diaphragm pump and a directional flow controller.

These and other objects are achieved in the invention by provision of a diaphragm pump having a pressurized enclosure, and a directional flow controller which may be used with pumps having pressurized enclosures. The diaphragm pump in accordance with the invention comprises a pump chamber, a diaphragm, an enclosure for containing at least the diaphragm, means for reciprocating the diaphragm, and means for regulating a fluid pressure within the enclosure.

The directional flow controller in accordance with the invention comprises a chamber or enclosure, means for regulating a fluid pressure within the chamber, a rotor, and means for rotating the rotor alternately to permit and prevent fluid communication between the chamber and a fluid outlet.

Further, in accordance with the invention, the diaphragm pump and valve may be combined in the same enclosure.

The invention and its particular features will become more apparent from the following detailed description when considered with reference to the accompanying drawings.

BRIEF DESCRIPTION OF THE DRAWINGS

FIG. 4 is an end elevation view of the controller of FIG. 1 showing the relative sizes and locations of the plate and timer motor.

FIG. 5 is an end cross-sectional elevation view of the pump and controller of FIG. 1 showing the relative sizes and locations of the pump and timer motor.

FIG. 6 is an enlarged clamshell view of the mating surfaces of the plate and rotor to the controller of FIG. 1, showing detail of the scaling portion of the rotor mating surface.

FIGS. 7A through 7C are enlarged end views of the mated plate and rotor of the controller of FIG. 1, showing the sealing and balancing portions of the rotor in dashed lines beneath the plate at three different locations.

DETAILED DESCRIPTION OF THE INVENTION

Figure 1:
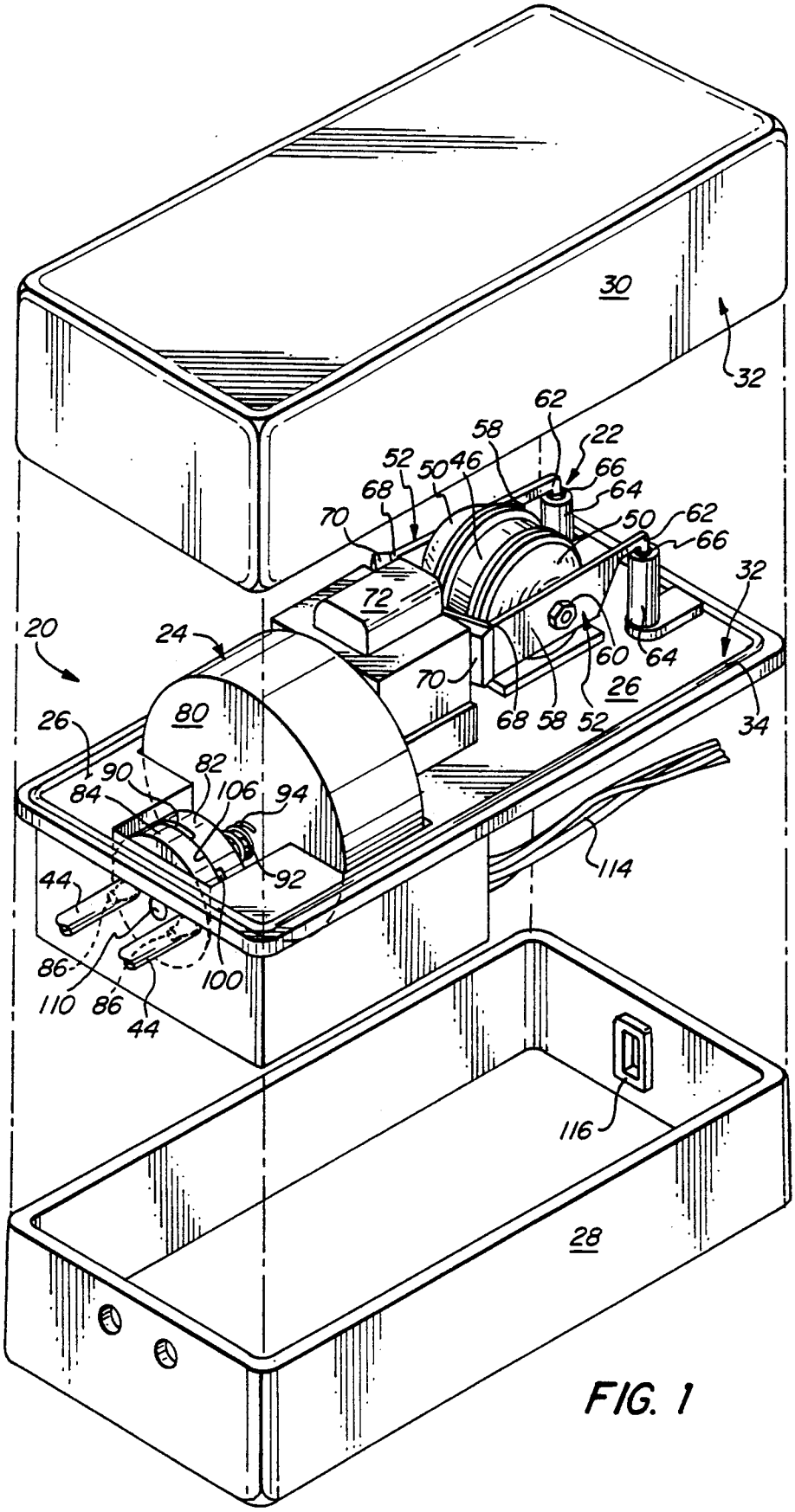
FIG. 1 is an exploded isometric assembly view of a diaphragm pump and directional flow controller in accordance with the invention.
Figure 2:
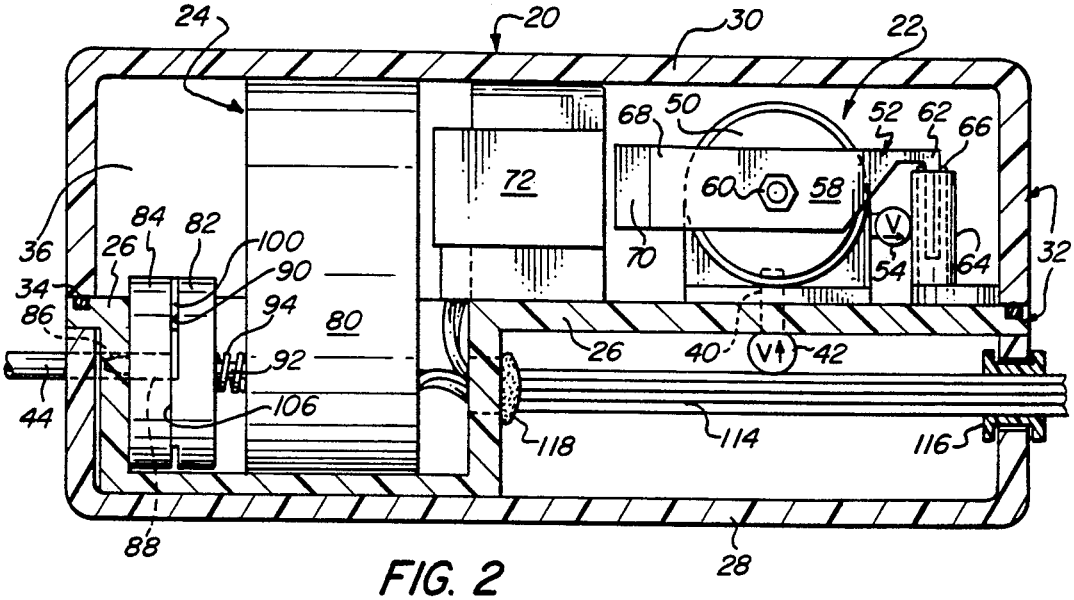
FIG. 2 is a front cross-sectional elevation view of the pump and controller of FIG. 1.
Figure 3:
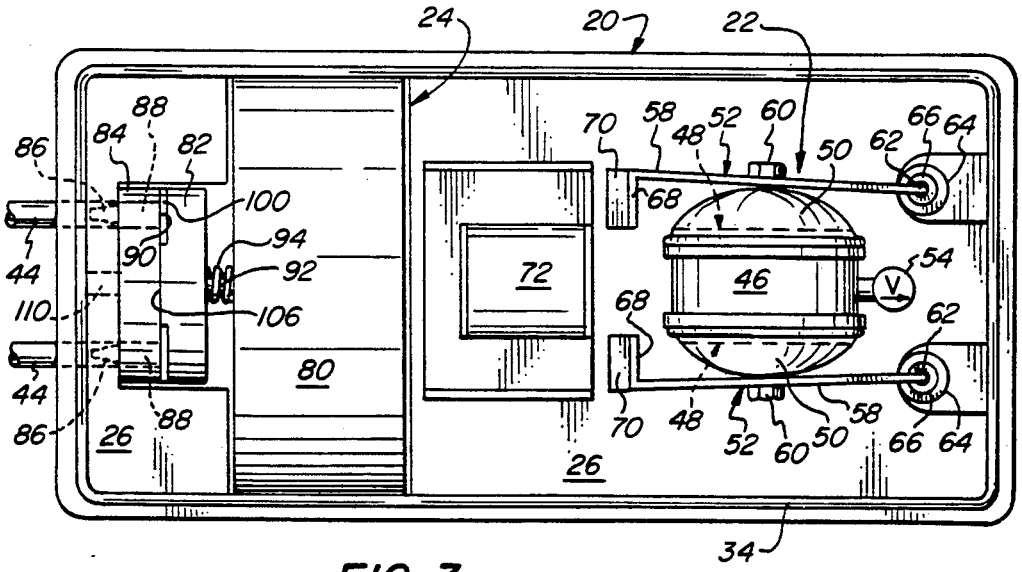
FIG. 3 is a top plan view of the pump and controller of FIG. 1 with the upper cover removed.

FIGS. 1 to 3 and 5 provide various views of a fluid pump assembly 20 including a diaphragm pump 22 and a valve or directional flow controller 24 in accordance with the invention. Pump assembly 20 comprises a base 26, a lower cover 28, and an upper cover 30. Diaphragm pump 22 and flow controller 24 are mounted to base 26, and received and contained within upper cover 30 and base 26 which together form an enclosure 32.

Base 26 and upper cover 30 are preferably substantially sealed with an O-ring or the like 34 and fastening means (not shown in any FIGURE). Any known fastening means including glue, screws, clamps, etc. may be used. Enclosure 32 defines an enclosed volume 36 within which diaphragm pump 22 and flow controller 24 are preferably substantially hermetically sealed except for fluid conduits including a fluid inlet 40 having a one-way or check valve 42 for receiving ambient fluid; and at least one, and preferably two, fluid outlets 44.

Diaphragm pump 22 comprises a pump chamber 46 into which fluid inlet 40 is sealed permitting ingress of fluid to the chamber. Pump chamber 46 is open to at least one, and preferably two, sides 48 (see FIG. 3), and includes a diaphragm 50 sealed over each open side. Armatures 52 or other like means are provided for reciprocating diaphragms 50 to pump fluid. Diaphragms 50 are preferably formed from elastomeric material, but may also be formed from polymeric or other mateirals. Diaphragm pump 22 also includes an outlet check valve 54 whereby fluid may be pumped into pump chamber 46 through check valve 42 and fluid inlet 40, and out of pump chamber 46 through outlet check valve 54.

According to a preferred embodiment, diaphragm pump 22 pumps filled out through outlet check valve 54 directly within enclosure 32 into enclosed space 36. In this regard, diaphragm pump 22 comprises means for regulating a pressure of fluid in enclosed space 36 at a level above ambient fluid pressure. By "regulating" is meant that a particular or threshold pressure is substantially maintained within the enclosure. Although not necessary, a pressure relief valve (not shown in any FIGURE) may be used for this purpose. By "ambient fluid pressure" is meant the pressure of the fluid, surrounding enclosure 32, which is received at fluid inlet 40. In other embodiments, diaphragm pump 22 pumps fluid directly without enclosure 32 and a separate pressure regulating means may be provided. For example, the pressure of fluid in enclosed space 36 may be maintained at a level above ambient fluid pressure simply by sealing enclosure 32 at the elevated fluid pressure level. Diaphragm pumps having such a pressurized enclosure enjoy advantages over conventional pumps operating at ambient pressures. These advantages will be discussed more completely below with reference to FIG. 8 and 9.

Armatures 52 include arm members 58 which are secured to diaphragms 50 by a nut and bolt combination 60 or the like. Arm members 58 comprise a first end 62 pivotally mounted in pivot support 64 with a washer 66, and a second end 68 for reciprocation about pivot support 64. Second end 68 of arm member 58 preferably includes a permanent magnet 70 located in proximity to an electromagnet 72 for reciprocation thereby, in a known manner. In addition to armatures 52, other means for reciprocating diaphragms 50 are known and possible including electromagnets without armatures, second fluid pumps, and the like.

Pivot supports 64 and pump chamber 46 may be integrally molded with base 26 to obtain the benefits disclosed in my earlier U.S. Pat. No. 4,610,608.

Referring now to FIGS. 1 to 4 and 6, fluid directional controller 24 comprises a timer motor 80, a rotor 82, and a plate 84. Plate 84 is mounted to base 26 within enclosure 32 and receives fluid outlets 44 via fittings 86. Hose fitting 86 are mounted to fluid outlet holes 88 which extend completely through plate 84 to plate mating surface 90. Preferably, plate 84 may be eliminated and an inner wall of enclosure 32 may comprise the plate mating surface. Thus, fluid introduced to fluid outlet holes 88 may pass through plate 84, through fittings 86, and out of enclosure 32 through fluid outlet conduits 44.

Rotor 82 is maintained in an aligned position relative to plate 84 by drive shaft 92 of timer motor 80. Spring 94 is held in compression between timer motor 80 and rotor 82 to press rotor mating surface 96 of rotor 82 firmly against plate mating surface 90 of plate 84. Indeed, mating surfaces 90 and 94 are preferably formed smoothly enough to be substantially hermetically sealable with a minimum of force provided from spring 94 due to the internal pressure of the enclosure. Reducing the amount of force applied by spring 94 to rotor 82 permits reduction in the amount of torque necessary to be applied by timer motor 80 in order rotate rotor 82. Lower torque requirements means a smaller, cheaper, more efficient timer motor may be used.

Rotor mating surface 82 include as a slot 100, a sealing portion 104, and a balancing portion 106. Slot 100 preferably extends to an edge 102 of rotor 82, and functions to permit fluid communication between enclosed space 36 (within enclosure 32) and fluid outlet holes 88. Sealing portion 104 of rotor mating surface 96 conversely functions to prevent fluid communication between enclosed space 36 and outlet holes 88. Balancing portion 106 of rotor mating surface 96 functions to insure that spring 94 presses rotor 82 substantially squarely against plate 84 to improve sealabilty of respective mating surfaces 96 and 90. Further, in this regard, drive shaft 92 of timer motor 80 is preferably connected to rotor 82 with a universal-type joint.

As timer motor 80 rotates rotor 82, as indicated by arrow 98, via drive shaft 92, fluid outlet holes 88 (and thus fluid outlets 44) are alternately in fluid communication, and out of fluid communication, with enclosed space 36. Thus, in embodiments where fluid in enclosed space 36 is substantially maintained at elevated pressures (by diaphragm pump 22 or otherwise), flow directional controller 24 alternately permits and prevents flow of pressurized fluid along fluid outlet conduits 44 out of enclosure 32 according to a schedule controlled by timer motor 80.

Plate 82 also includes a vent hole 110 which extends completely therethrough as well as through enclosure 32. Sealing portion 104 of rotor mating surface 96 is located such that vent 110 is substantially hermetically sealable from enclosed space 36. Rotor mating surface 96 preferably further includes a hollow 112 which is also substantially hermetically sealable from enclosed space 36.

Sealing portion 104 of rotor mating surface 96 is configured in conjunction with the arrangement of fluid outlet and vent holes 88, 110. Preferably, vent hole 110 is centrally located with respect to rotor 82, i.e. along a line through the center of rotation of rotor 82. Preferably also, the fluid outlet and vent holes 88, 110 are centered along aline. In this regard, the fluid outlet holes 88 are most preferably centered a distance of about one-half of one rotor radius R from the center of vent hole 110. With the preferred fluid outlet and vent hole alignment, sealing portion 96 preferably comprises a strip along one side of hollow 112 having three semicircular contours 109, 111 and 113, one semicircular contour centered on each of the fluid outlet and vent holes 88, 110. Central semicircular contour 111 is preferably aligned convexly outwardly, away from hollow 112, connecting vent 110 and hollow 112 in fluid communication. Flanking semicircular contours 109, 113 and preferably aligned convexly inwardly, toward hollow 112. Such a configuration permits vent 110 and hollow 112 to be sealed off from enclosed space 36; and as rotor 82 rotates, hollow 112 alternately places fluid outlet holes 88 in fluid communication with vent 110. It is understood that other configurations of fluid outlet and vent holes 88, 110, and of sealing portion 104 are possible.

Referring now to FIGS. 7A through 7C, the particular arrangement of sealing portion 104 of rotor mating surface 96 with respect to the outlet and vent holes 88, 110 is depicted at several discrete locations during rotation of rotor 82.

In FIG. 7A, rotor 82 is positioned such that fluid from enclosed space 36 may freely flow along slot 100, located between mating surfaces 90 and 96, and simultaneously into both fluid outlet holes 88. Thus, if each of the outlet holes were to be connected to separate bladders A, B as indicated (for example in a bed pad or the like), both bladders A, B would simultaneously be inflating or at substantially the same fluid pressure as enclosed space 36. Hollow 112 and vent hole 110 would, at this time in the cycle, be sealed off from enclosed space 36 and both fluid outlet holes 88.

In FIG. 7B, rotor 82 is positioned such that fluid from enclosed space 36 may freely flow along slot 100 and into only fluid outlet hole 88A. Rotor 82 is now positioned so that hollow 112 permits fluid communication between fluid outlet hole 88B and vent hole 110. Thus, to continue the example, bladder A would be inflating or at substantially the same pressure as enclosed space 36 while bladder B was simultaneously venting. FIG. 7C depicts substantially the same situation as FIG. 7B with bladders A and B reversed. It is understood that bladders need not be used, and that fluid outlet conduits 44 could be connected to storage areas, other loads or the like. It is also understood that by inflate is meant to fill with any fluid, not just air.

The bladder example presumes that the enclosed space 36 or other chamber containing directional flow controller 24 is regulated at a pressure above ambient pressure. However, it is understood that flow controller 24 may be used to direct a vacuum flow as well as pressurized fluid flow. In such case, by "regulate" is meant that a particular or threshold vacuum is substantially maintained within the enclosure. Although not necessary, a vacuum relief valve (not shown in any Figure) may be used for this purpose.

Returning briefly to FIGS. 1 and 2, fluid exhausted through vent 110 may conveniently be received within lower cover 28 to prevent disturbance of the environment containing pump assembly 20. Lower cover 28 also receives a power cord 114 through cord fitting 116. Cord fitting 116 permits vented fluid to either exit lower cover 28 or reenter fluid inlet 40. In this regard, the intake and exhaust noise of the pump are reduced. Power cord 114 enters enclosure 32 through a seal 118 to provide electricity to electromagnet 72 and timer motor 80 while preventing fluid in lower cover 28 from entering enclosure 32.

Figure 8:
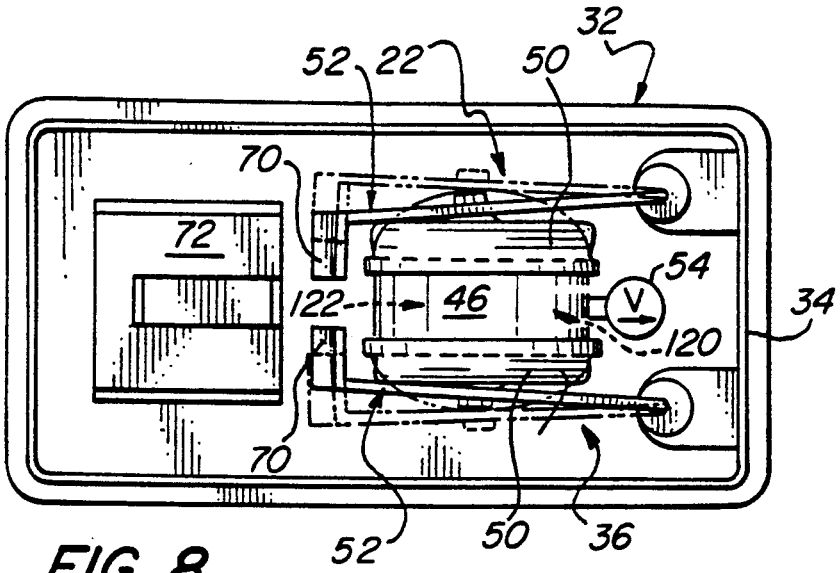
FIG. 8 and 9 are partial top plan views of the pump of FIG. 1 during operation in both a relatively highly pressurized enclosure (FIG. 8) and an unpressurized enclosure (FIG. 9) showing, for comparison, the at rest position of the armatures and diaphragms with ambient pressure on both sides of the diaphragms in dashed lines.
Figure 9:
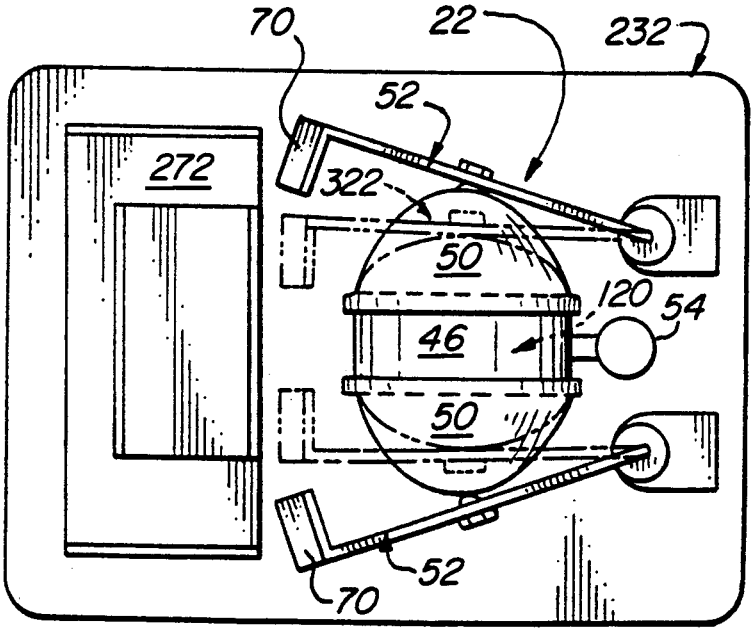
FIG. 9 (PRIOR ART)

Referring now to FIGS. 8 and 9, diaphragm pump 22 is depicted during operation in a relatively highly pressurized enclosure 32 (FIG. 8) and in an ambient or unpressurized enclosure 232 (FIG. 9). For purposes of comparing the operating positions of diaphragms 50 and armatures 52 in the two different enclosures, the dashed lines depict diaphragms 50 and armatures 52 in their nonoperating, at-rest positions with ambient fluid pressures on both sides of diaphragms 50. A pump chamber resting volume 120 is defined as the volume of pump chamber 46 and diaphragms 50 under these at-rest conditions, and is illustrated by diaphragms 50 in their dashed-line positions.

In addition to depicting operation in their respective enclosure types, the solid lines depict diaphragms 50 and armatures 52 with an average operating pressure on the inner sides of diaphragms 50. It is understood that the actual instantaneous pressure on the inner sides of diaphragms 50 varies with reciprocation of diaphragms 50 as well as a back pressure from pump chamber outlet check valve 54.

Referring now to FIG. 9, a pump chamber operating volume 322 is defined as the volume of pump chamber 46 and diaphragms 50 under average operating conditions within ambient enclosure 232, and is illustrated by diaphragms 50 in their solid-line positions. Prior art enclosure 232 is unpressurized and pressurized fluid passing out of pump chamber 46 through outlet check valve 54 is transmitted to a load (not shown in any Figure) such as an inflatable bladder. As diaphragm pump 22 operates, a back pressure develops through outlet check valve 54 and bach into pump chamber 46. This back pressure causes distension or ballooning of diaphragms 50 such that pump chamber operating volume 322 is larger than pump chamber resting volume 120 for diaphragm pumps 22 housed in prior art ambient pressure enclosures 232.

This ballooning of prior art diaphragm pumps gives rise to numerous disadvantages. Larger, more obtrusive enclosures are required to house the pumps. The diaphragms require more frequent replacement and a more secure seal to the pump chamber. A larger electromagnet 272 is required for efficient pump operation, i.e. proper registration of permanent magnets 70 with electromagnet 272.

Referring now to FIG. 8, these problems can be alleviated and additional advantages obtained by placing diaphragm pump 22 within pressurized enclosure 32. Regulating the pressure within enclosed space 36 at a level above ambient fluid pressure, i.e. at a level necessary to reduce distension of diaphragms 50, is all that is required. By pressurizing enclosure 32, the force of the back pressure tending to balloon diaphragms 50 effectively may be opposed. Thus, a pump chamber operating volume 122, defined as the volume of pump chamber 46 and diaphragms 50 under average operating conditions within pressurized enclosure 32, is smaller than pump chamber operating volume 322 (see FIG. 9). Diaphragms 50 last longer, and need not be as securely sealed to pump chamber 46 saving materials and labor in pump assembly. Smaller electromagnet is 72 may be used while maintaining registration with permanent magnets 70 of armatures 52. Smaller, less obtrusive enclosures may be used. Further, the invention has found that at loads of 64 inches of water, a diaphragm pump in pressurized enclosure 32 provides a flow rate of 1.6 liters of minute, while the identical pump in prior art enclosure 232 provides a flow rate of only 0.6 liters per minute. Thus, smaller pump chambers may be used to achieve similar flow rates. It has also been found that pressurized enclosures, especially where the enclosed pump pressurizes the enclosure, provide quieter pump assemblies, permitting muffler systems such as that disclosed in my earlier U.S. Pat. No. 4,610,608 to be eliminated.

Most preferably, the pressure of fluid within enclosed space 36 is regulated at a sufficiently high level that pump chamber operating volume 122 is less than pump chamber resting volume 120, although advantages may be obtained at any enclosed space pressure which reduces diaphragm distension. Also, diaphragm pump 22, itself, most preferably regulates the fluid pressure within enclosure 32.

Figure 10:
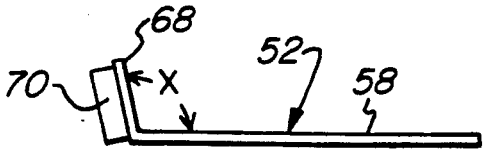
FIG. 10 is a top view of an armature for the pump of FIG. 1.

Returning now to FIGS. 8 and 10, permanent magnet 70 is most preferably mounted to second end of armature 52 at an angle X of greater than ninety degrees with respect to arm member 58. In this regard, as armatures 52 are forced together when diaphragms 50 begin collapsing due to the elevated fluid pressure within enclosure 32, permanent magnets 70 will be aligned substantially in parallel with electromagnet 72.

Returning to FIGS. 1 through 3, the inclusion of directional flow controller 24 within pressurized enclosure 32 provides additional advantages for pump assembly 20. As described above, the disclosed plate 84 and rotor 82 design enables distribution and directional control of pressurized fluid from fluid pump 22 via pressurized enclosure 32. This design saves further material and labor costs in assembly since no tubing is necessary to transmit pressurized fluid to flow to controller 24, and indeed no plate is necessary as opposed to flow controllers such as that disclosed in my earlier U.S. Pat. No. 5,009,579 which operate at ambient pressure. Directional control may be achieved without the plate required in current designs, as the inside surface of the enclosure is smooth enough to achieve an adequate seal in pressurized enclosures, eliminating need for a more precisely lapped plate.

Figure 11:
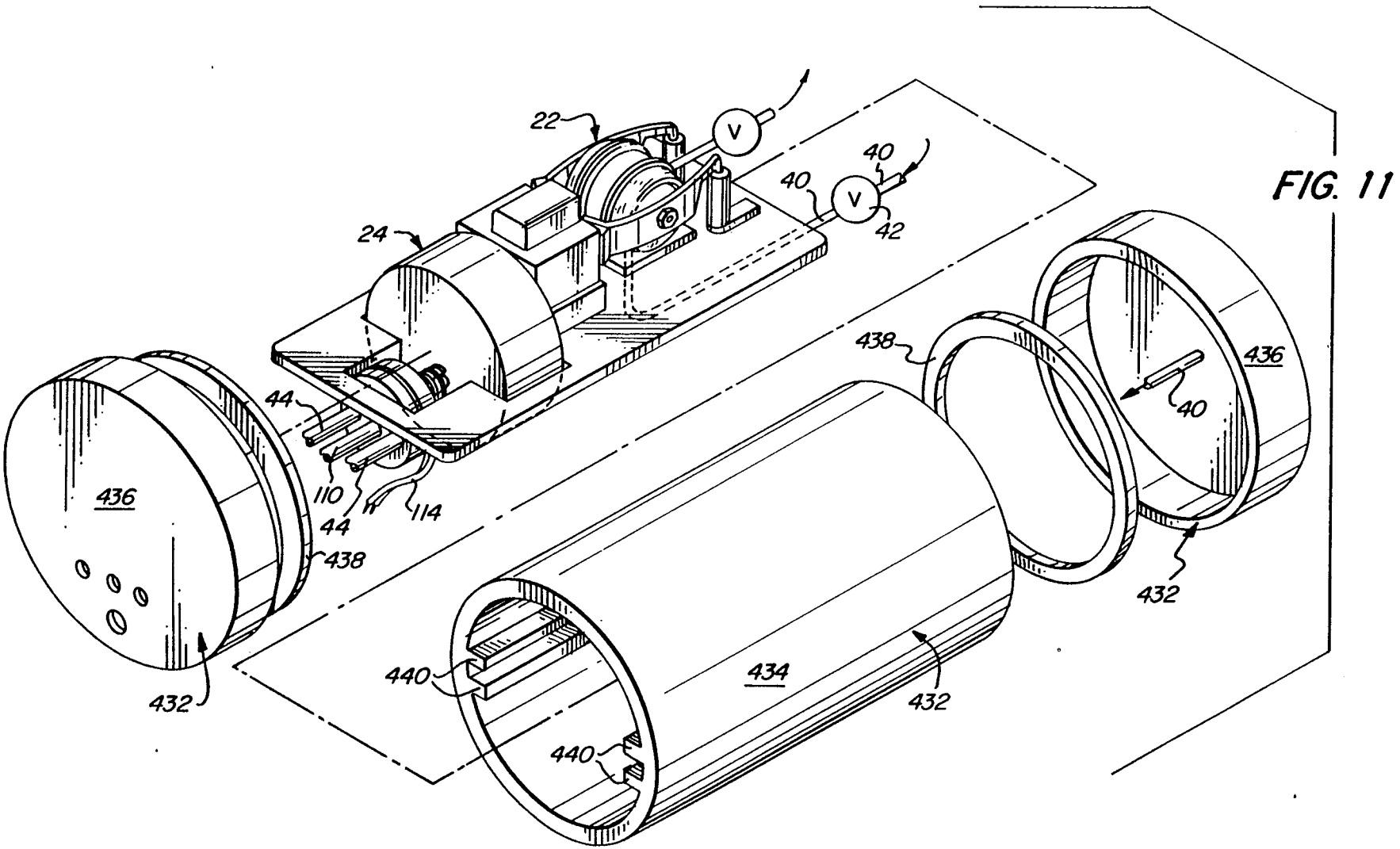
FIG. 11 is an exploded isometric assembly view of the pump of FIG. 1 in a differently shaped enclosure.

Referring to FIG. 11, diaphragm pump 22 and directional flow controller 24 are shown mounted within a different pressurized enclosure 432 comprising a tube 434 and end caps 436. At least one end cap 436 preferably includes a sealing gasket 438 permitting relatively easy assembly and disassembly of the enclosure by, for example, unscrewing the end cap. The other end cap may be similarly removably sealed or may be more permanently sealed to the tube. Base 26 is slidably mountable in slots 440 connected to tube 434. Inlet 40, outlets 44, vent 110 and power cord 114 are sealed through end caps 436. Use of a cylindrical pressurized enclosure such as 432 generally simplifies the sealing of enclosed volume 436 thereof.

Although the invention has been described with reference to particular embodiments, features and the like, these are not intended to exhaust all possible features, and indeed many other modifications and variations will be ascertainable to those of skill in the art.

What is claimed is:

1. A fluid pump comprising:

a pump chamber open to at least one side;

at least one diaphragms sealing the open side of said pump chamber and, with ambient pressure on inner and outer sides of said diaphragm, defining a pump chamber resting volume, an enclosure for receiving and containing at least said diaphragm, said enclosure defining an enclosed volume and including a fluid outlet;

means for reciprocating said diaphragm to alternately enlarge and diminish a pump chamber operating volume to pump fluid, the pump chamber operating volume defined with ambient pressures within said enclosure on the outer side of said diaphragm and with an average pressure on the inner side of said diaphragm due to reciprocation of said diaphragm and a back pressure; and means for regulating a pressure within said enclosure at a sufficiently high level above ambient pressure to reduce the pump chamber operating volume.

2. The fluid pump of claim 1 wherein said regulating means comprises a source of pressurized fluid in fluid communication with said enclosed volume.

3. The fluid pump of claim 1 wherein said regulating means comprises a fluid passageway extending between said pump chamber and said enclosed volume, and wherein said reciprocating means pumps fluid from said pump chamber into said enclosed space to maintain the pressure within said enclosure at the sufficiently high level.

4. The fluid pump of claim 3 wherein said regulating means comprises substantially sealing said enclosure around said diaphragm.

5. The fluid pump of claim 1 wherein said regulating means regulates the pressure within said enclosure at a sufficiently high level that the pump chamber operating volume is less than the pump chamber resting volume.

6. The fluid pump of claim 1 including two diaphragms, and wherein said pump chamber is open to two sides, one open side sealed by each diaphragm.

7. A fluid pump comprising:

a pump chamber including at least one elastomeric diaphragm;

an enclosure for receiving said sealingly containing at least a portion of said pump chamber and said diaphragm, said enclosure defining an enclosed volume and including a fluid conduit; and means for reciprocating said diaphragm to pump fluid between said pump chamber and said enclosed volume to regulate a pressure within said enclosure at a level other than ambient pressure.

8. The fluid pump of claim 7 wherein said fluid conduit is a fluid outlet, and wherein said reciprocating means pumps fluid from said pump chamber into said enclosed volume to regulate the pressure within said enclosure at a level above ambient pressure.

9. The fluid pump of claim 7 wherein said reciprocating means is also located within said enclosure.

10. The fluid pump of claim 8 wherein said reciprocating means comprises an arm member secured to said diaphragm.

11. The fluid pump of claim 7 wherein said reciprocating means comprises an electromagnet.

12. The fluid pump of claim 7 wherein said enclosure is at least substantially sealed around said pump chamber portion and said diaphragm.

13. The fluid pump of claim 8 wherein said reciprocating means regulates the pressure within said enclosure at sufficiently high level above ambient pressure to reduce distension of said diaphragm.

14. The fluid pump of claim 7 wherein said fluid conduit comprises first and second fluid conduits, and including a fluid directional controller located within said enclosure for alternately permitting fluid passage between said enclosure and said fluid conduits.

15. In a fluid pump of the type having a pump chamber including at least one elastomeric diaphragm, an arm member with first and second ends, the arm member secured to the elastomeric diaphragm, means for pivotally supporting the first end of the arm member, means for reciprocating the second end of the arm member to reciprocate the elastomeric diaphragm and pump fluid, and an enclosure for receiving and containing the pump chamber, the arm member, the supporting and reciprocating means, the improvement comprising:

said enclosure being at least substantially sealed around said pump chamber, and including at lest one fluid outlet; and said pump chamber adapted to discharge pressurized fluid into said substantially sealed enclosure upon reciprocation of said arm member to regulate pressure within said enclosure at a sufficiently high level to reduce ballooning of the elastomeric diaphragm, whereby an overall size of said enclosure may be reduced.

16. The improved fluid pump of claim 15 wherein the reduced ballooning of the elastomeric diaphragm during operation also permits reduction in the size of the pumping chamber which would otherwise be necessary to provide a similar rate of fluid pumped.

17. The improved fluid pump of claim 15 wherein the arm member reciprocating means comprises an electromagnet, and wherein the reduced ballooning of the elastomeric diaphragm during operation also permits reduction in the size of the electromagnet which would otherwise be necessary to effectively reciprocate the arm member.

18. The improved fluid pump of claim 15 wherein said reciprocating means comprises an electromagnet and wherein said arm member includes a magnet mounted at an angle of greater than 90° to a remainder of said arm member such that magnet is substantially in planar alignment with a pole of said electromagnet during operation of the fluid pump.

19. The improved fluid pump of claim 15 including a pressurized fluid directional controller located within said enclosure.

20. The improved fluid pump of claim 19 wherein said pressurized fluid directional controller comprises a rotor which, upon rotation, alternately permits said prevents egress of pressurized fluid out of said enclosure through said fluid outlet according to a timed schedule.

* * * * *